United States Patent [19]

Bonali

[11] Patent Number: 4,664,577

[45] Date of Patent: May 12, 1987

[54] APPARATUS FOR STACKING GENERIC SHEET-LIKE ELEMENTS SUCH AS SHEETS, HIDES, BOARDS, AND THE LIKE

[76] Inventor: Vincenza Bonali, Via Corridoni 28, Turbigo (Province of Milan), Italy

[21] Appl. No.: 752,781

[22] Filed: Jul. 8, 1985

[30] Foreign Application Priority Data

Jul. 18, 1984 [IT] Italy ..... 21937 A/84

[51] Int. Cl.[4] ..... B65H 29/04

[52] U.S. Cl. ..... 414/86; 271/65; 271/85; 271/186

[58] Field of Search ..... 414/91, 86; 271/65, 271/81, 82, 190, 85, 186, 204; 198/470.1, 803.7, 803.9

[56] References Cited

U.S. PATENT DOCUMENTS

| | | | |
|---|---|---|---|
| 3,370,849 | 2/1968 | Martin | 271/186 X |
| 3,951,400 | 4/1976 | Blessing et al. | 271/85 |
| 3,960,374 | 6/1976 | Gaffney | 271/204 X |
| 3,989,239 | 11/1976 | Scriven, Jr. et al. | 271/204 |
| 4,269,408 | 5/1981 | Heater | 271/190 X |
| 4,479,645 | 10/1984 | Pollich | 271/204 X |

FOREIGN PATENT DOCUMENTS

| | | | |
|---|---|---|---|
| 424309 | 2/1935 | United Kingdom | 271/204 |

*Primary Examiner*—Robert J. Spar
*Assistant Examiner*—Janice Krizek
*Attorney, Agent, or Firm*—Guido Modiano; Albert Josif

[57] ABSTRACT

The apparatus comprises a load-bearing frame overlying a stacking stand or shelf and supporting at least one gripping element connected to an entrainer and adapted to pick up a sheet-like element being fed from a transport. The apparatus further comprises an element for supporting the sheet-like element as picked up from the transport and actuated by at least one gripping element during its movement to entrain the sheet-like element, members for disengaging the supporting element from the at least one gripping element, and members for opening at least one of the gripping elements cooperating sequentially with one another to then release the sheet-like element which is deposited onto the stack on the stacking stand or shelf.

12 Claims, 13 Drawing Figures

APPARATUS FOR STACKING GENERIC SHEET-LIKE ELEMENTS SUCH AS SHEETS, HIDES, BOARDS, AND THE LIKE

BACKGROUND OF THE INVENTION

This invention relates to an apparatus for stacking generic sheet-like elements such as sheets, hides, boards, and the like.

As is known, in order to unload sheet-like elements such as hides, sheets, boards, and the like from a continuously moving conveyor belt, purely manual techniques are currently used whereby an operator picks up the various sheet-like elements and locates them on a stand or shelf which acts as a collector.

It will be appreciated that such a procedure involves a significant labor input which reflects heavily on production costs.

In an attempt to obviate such drawbacks, apparatuses have been provided which allow the various sheet-like elements to be laid in a substantially automatic fashion on the stand or shelf. With such apparatuses, the shelf is translated continuously in the sheet-like element's feeding direction, relatively to the conveyor belt, thereby an oncoming sheet-like element is practically deposited on the stand which moves relatively to it.

However, this approach has various disadvantages, the first of which is that the continuous movement of the stand whereon the sheet-like elements are stacked may create unbalance in the stack of sheet-like elements which may then be dropped. A further disadvantage is that in general the shelf and conveyor belt lie in different planes which, in general, are spaced far apart, thereby causing the sheet-like element to practically fall like a dead leaf onto the shelf or stand, thereby creating significant errors in the positioning of the sheet-like elements.

Another prior approach, which is in practice the kinematic reverse of the former, provides for the shelf to be held stationary, thus reducing the risk of the stack of sheet-like elements collapsing, and for the conveyor belt to be continuously moved relatively to the shelf as the various sheet-like elements are being fed.

However, this approach is very complicated to realize by virtue of the large moving masses involved, which comprise entire displacement movement of the actual feed mechanism.

Another disadvantage shared by the embodiments just described is that such apparatuses are of large size because the stand and conveyor have a combined length which is at least twice the length of the sheet-like element to be stacked.

SUMMARY OF THE INVENTION

It is the aim of this invention to obviate the above disadvantages by providing an apparatus for stacking generic sheet-like elements such as sheets, hides, and the like, whereby the various sheet-like elements can be piled or stacked together without involving large moving masses and without moving the shelf or stand along the feed direction of the sheet-like elements.

Within the above aim, it is a particular object of the invention to provide an apparatus wherein the distance of the sheet-like element stacking area from the location where the sheet-like elements are practically dropped onto the stack of previously stacked sheet-like elements can be minimized.

Another object of this invention is to provide an apparatus for stacking sheet-like elements which affords an appreciable reduction in the length dimension of the machine, and the possibility of making the overall length of the machine substantially the same as the maximum admissible length for the sheet-like elements plus approximately a half-meter.

A further object of this invention is to provide an apparatus which affords, through extremely simple means, the possibility of alternately tilting over the various sheet-like elements so as to accomplish the stacking, e.g. of hides, with always the same faces in mutual contact, that is a grain-to-grain contact alternating with a back-to-back contact.

Still another object of the invention is to provide an apparatus which, owing to its peculiar construction, can give full assurance of being reliable and safe to use.

The aforesaid aim, and these and other objects which will become apparent hereinafter, are achieved by an apparatus for stacking generic sheet-like elements such as sheets, hides, boards and the like, according to the invention, characterized in that it comprises a load-bearing frame overlying a stack supporting means and supporting at least one gripping element connected to an entrainer and adapted to pick up a sheet-like element being fed from a transport, an element for supporting the sheet-like element as picked up from said trasport and actuated by said at least one gripping element during its movement to entrain said sheet-like element, means of disengaging said supporting element from said at least one gripping element, and means of opening said at least one gripping element cooperating sequentially with one another.

DESCRIPTION OF THE DRAWINGS

Further features and advantages will become apparent from the following description of a preferred but not exclusive embodiment of an apparatus for stacking generic sheet-like elements such as sheets, hides, boards, and the like, with reference to the accompanying illustrative and not limitative drawings, where.

DESCRIPTION OF THE PREFERRED EMBODIMENTS

Figure 1:
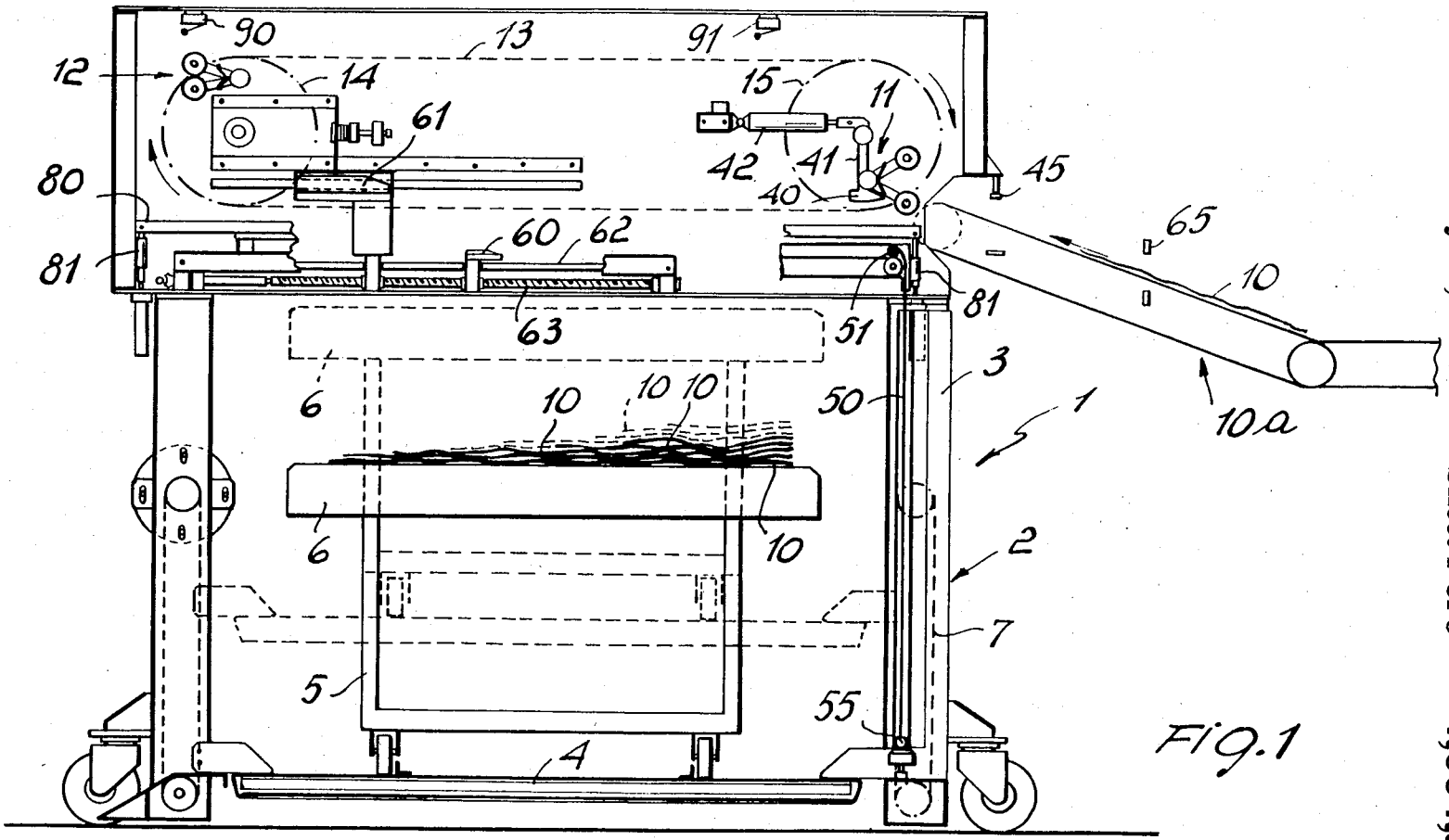
FIG. 1 is a side view showing diagramatically the apparatus of this invention.

With reference to the cited drawing figures, an apparatus for stacking generic sheet-like elements such as sheets, hides, boards, and the like, according to the invention, comprises a load-bearing frame, generally designated with the reference numeral 1, which consists of a frame 2 having uprights 3 which support a crosspiece 4 whereon a carriage 5 is provided to support a stack supporting member such as a shelf or stand 6.

The crosspiece 4, as is customary, is connected to chain means 7 housed within the uprights 3 and operative to change the relative height of the carriage 5 and frame 1, as shown in dash lines in FIG. 1.

On the upper portion of the load-bearing frame 1, there is provided at least one gripping element which is connected to an entrainer and effective to pick up a sheet-like element 10 fed from a transport 10*a*, advantageously of the endless belt type.

In this particular case, the gripping element comprises a first gripper 11 and a second gripper 12 which are connected to an entrainment chain 13 forming the entrainer and being trained around a first sprocket 14 and a second sprocket 15 in a closed loop.

The grippers 11 and 12 are connected at substantially diametrically opposite locations with respect to the chain for reasons to be explained hereinafter.

Figure 3:
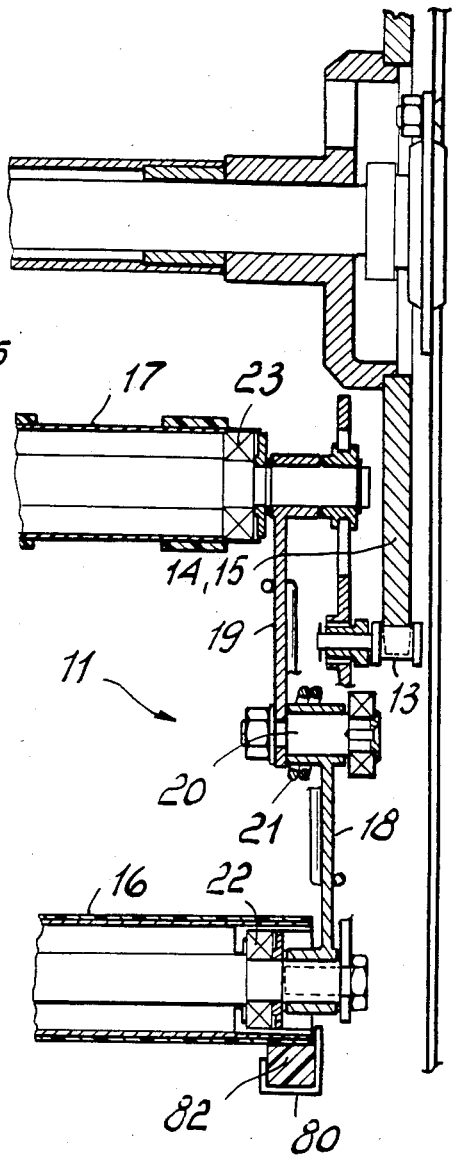

The first gripper 11, as shown best in FIG. 3, comprises a lower roller 16 and an upper roller 17, which are respectively connected to a lower arm 18 and an upper arm 19 pivotally connected together through a central pin 20 and elastically interlinked by a flexure spring 21.

The lower roller 16 is supported for rotation about its axis through bearings 22, while the upper roller 17 is journalled on freewheel means 23 which only permit its rotation in one direction.

The second gripper 12 has a first roller, indicated at 25, and a second roller, indicated at 26, which are also connected respectively to a lower arm and an upper arm, again indicated at 18 and 19, which are interlinked by a center pin, again indicated at 20.

The first roller 25 is fixed about its axis, as is the second roller 26.

At the ends of the first roller 25, there is an idler roller 27 whose function will be explained hereinafter.

Figure 2:
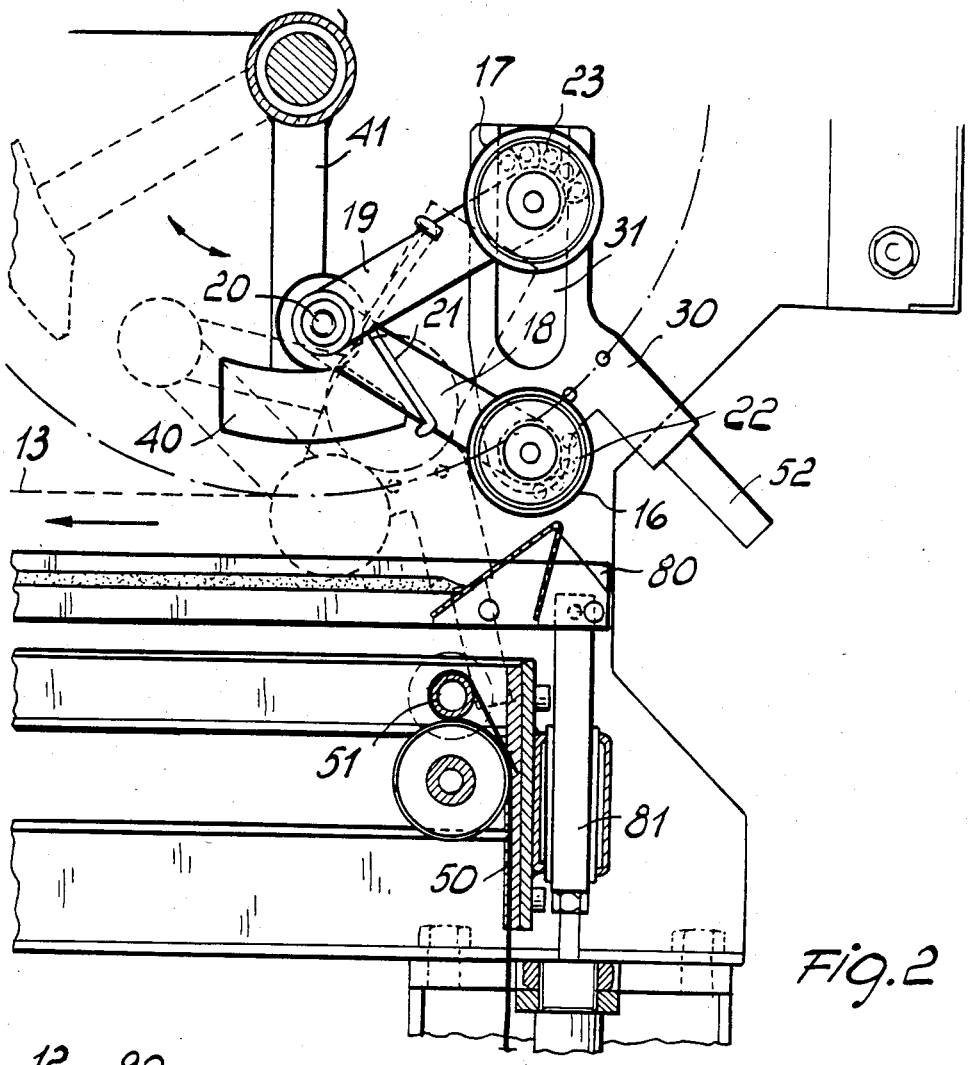
FIG. 2 is a detail view of the gripping element and of the supporting element.

As illustrated in FIG. 2, the rollers are supported on a guide plate 30, attached to the chain 13, wherein the lower roller 16 and first roller 25 have fixed axes, whereas the upper roller 17 and roller 26 have axes which are movable within a slot 31 formed in the plate for reasons to be explained hereinafter.

At the inlet area of the sheet-like elements from the transport 10*a*, there is provided a means of opening the grippers which comprises a cam 40 connected to an arm 41 actuated by an opening piston 42. The cam 40, in engaging with the center pin 20, causes a translation of the second roller 17 and upper roller 26 within the slot 31, which results in the gripper being opened.

In operation, the gripper will be positioned at the outlet area of the transport 10*a* and held open until a sheet-like element 10 is introduced therein. The closure of the gripper elements is driven by a sensor 45, preferably of the photocell type, which controls the cylinder 42 to execute the elastic closure of the related rollers upon the sheet-like element 10 being introduced into the gripper.

Once the sheet-like element has been gripped, the chain 13 is driven to translate the gripper elements and thus cause the sheet-like element to be entrained by the gripper elements.

In its translatory movement of entrainment of the sheet-like element, the gripper element actuates a support element consisting of a web 50 having at the top an upper bar 51 which engages with a lug 52 defined by the gripper element such that in its reciprocation the gripper element will take, below the picked up sheet-like element, the support web which is counterweighed at its lower end by means of a counterweight 55.

On the load-bearing structure 1, there is provided a means of disengaging the cloth 50 from the sheet-like element which comprises a cam 60 operative to spread the lugs 52 apart and consequently disengage them from the bar 51. In this condition, the counterweight returns the cloth quickly to the starting position.

Also provided is a means of opening the gripper element comprising a release cam 61 which engages with the pin 20 to effect the opening of the related gripper element in a similar way to the previously described procedure.

Both the disengagement cam 60 and the release cam 61 are translatable along a slide bar 62 by the action of a threaded bar 63 engaging with corresponding screw nuts defined on the cams 60 and 61 and being linked operatively to means 65 provided on the belt 10*a* and adapted to detect the length of the sheet-like element.

The positioning of the cams 60 and 61 causes the disengagement of the gripper element of the sheet-like element to occur in conformity with the length of the sheet-like element, thereby all the sheet-like elements on the shelf 6 are arranged with one end, i.e. the end facing the transport, aligned.

The apparatus also comprises means of carrying out the stacking of the various sheet-like elements in alternating tilt-over relationship, that is by tilting over one sheet-like element and not the next, tilting over the subsequent one, and so forth.

Such means are in the form of a bar 80 which is vertically reciprocable through the action of small pistons 81 and adapted to engage with the ends of the lower roller 16 and first roller 25.

Figure 8:
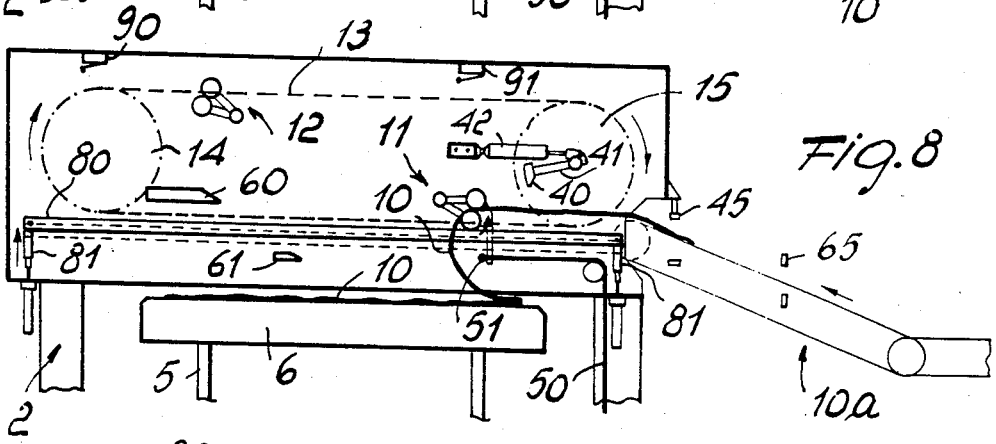
FIG. 8 illustrates a sheet-like element tilt over phase.
Figure 9:
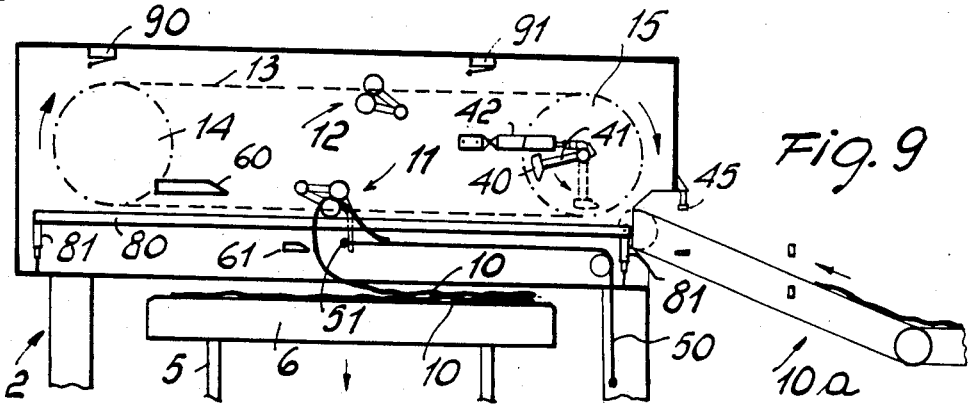
FIG. 9 shows the terminal phase of resting a tilted over sheet-like element.

The lower roller 16, as previously described herein, is mounted rotatably about its own axis, thereby on contacting a friction bar 82, carried on the reciprocable bar 80, it causes the roller to turn about its axis, with consequent entrainment of the sheet-like element into the gripper nip, thereby, as brought out in FIG. 8, the sheet-like element is laid onto the pile or stack of sheet-like elements and tilts over.

The second gripper element, as mentioned above, is provided at that end of the roller 25 which is not rotatable about its axis with an idler roller, thereby the engagement of the idler roller with the friction bar 82 will produce no rotation of the rollers and consequent tilting over of the sheet-like element.

Since, as mentioned above, there are provided on the chain 13 two diametrically opposing gripper elements, the sheet-like elements will be picked up in succession by the first and second gripper elements, thereby accomplishing automatically the tilting over of one sheet-like element and not of the next element, and so forth.

It should be further added to the foregoing that means are provided for locking the gripper elements in place which comprise a chain locking sensor 90 operative with a gripper element positioned at the outlet end of the transport 10*a*.

Also provided is a sensor of the opening of the grippers 91 which is located at the sprocket 15 such that the gripper, before reaching the outlet from the transport 10, will actuate the opening cylinder 42 with the cam 40 being positioned to effect opening of the gripper.

Figure 5:
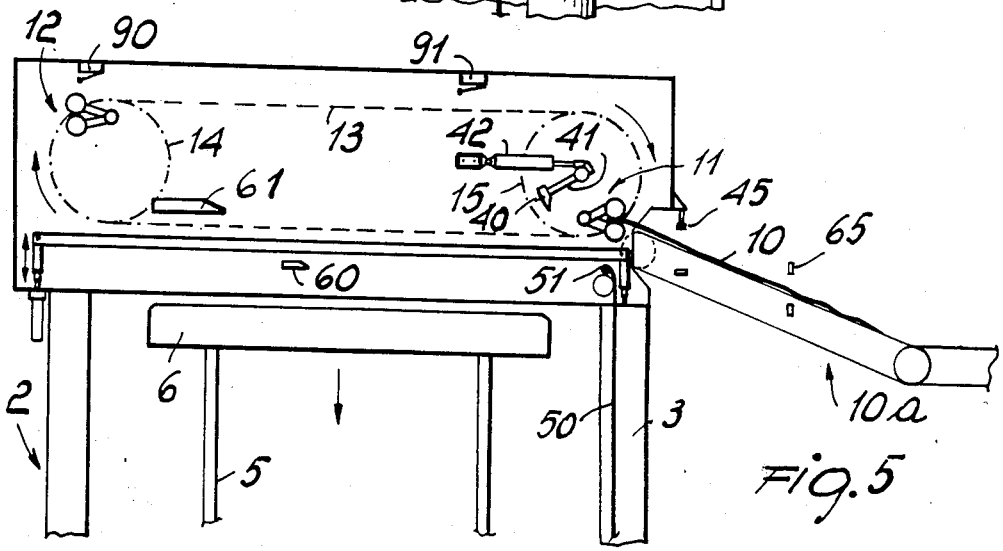
FIG. 5 diagramatically illustrates the phase of engagement of the sheet-like element by the gripping element.
Figure 2:
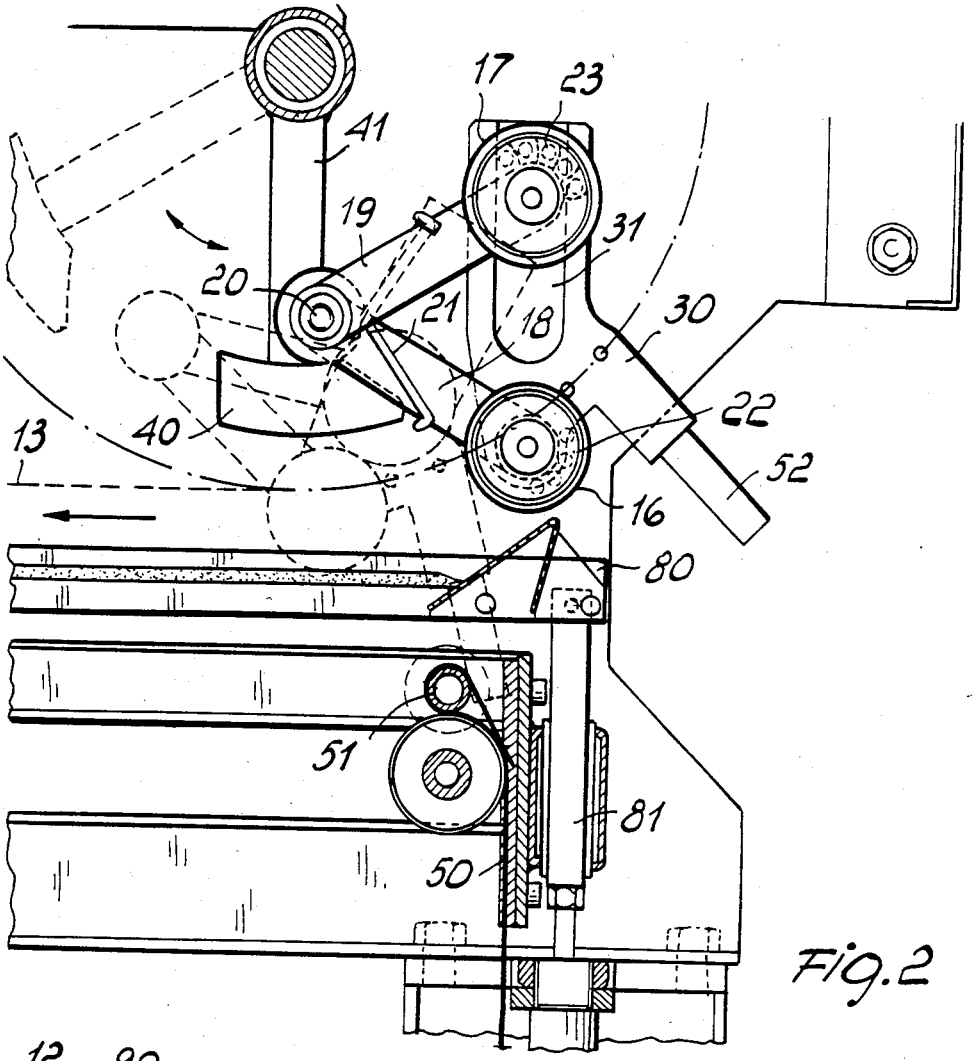
Figure 5:
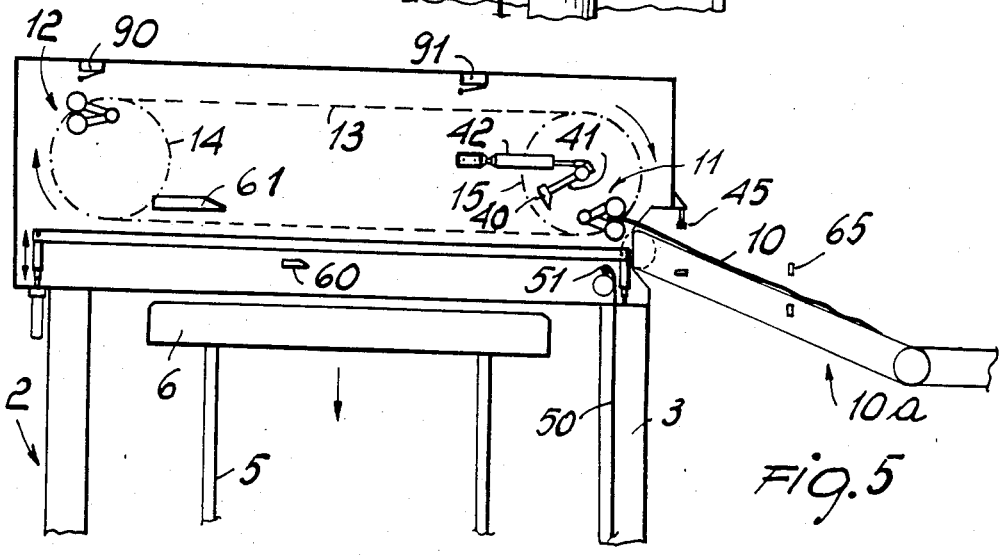
Figure 4:
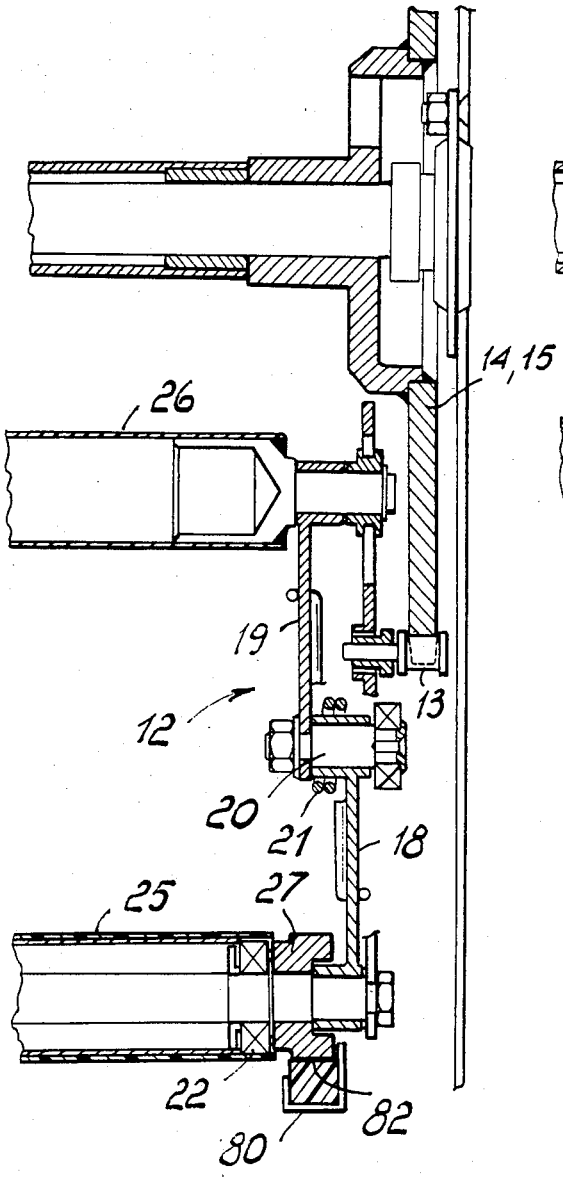
FIGS. 3 and 4 are sectional views showing diagramatically the two gripping elements employed.
Figure 6:
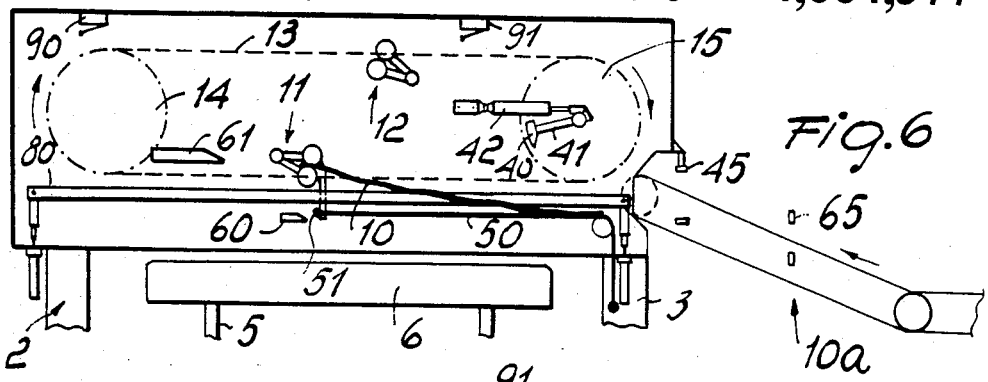
FIG. 6 illustrates the sheet-like element entrainment phase.
Figure 7:
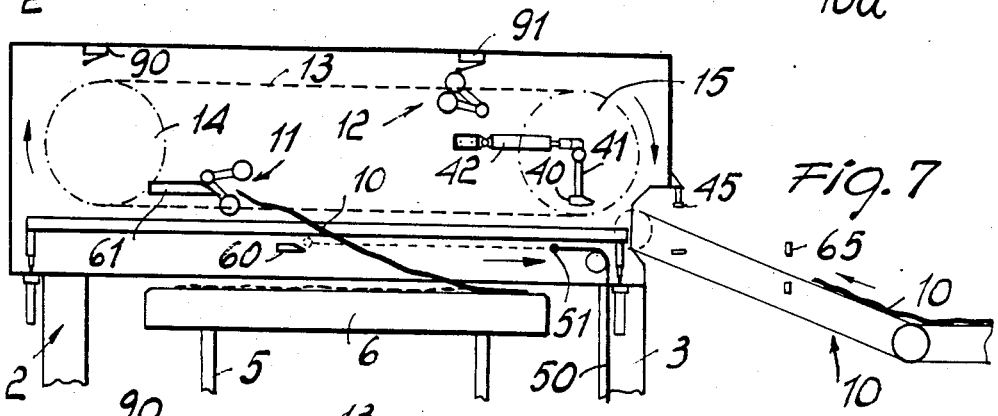
FIG. 7 illustrates the sheet-like element release phase.

With the apparatus in operation, where it is not required that the sheet-like elements be tilted over alternately, the bar 80 would be held in its lowered position; in this condition, those gripper elements which are positioned at the outlet from the transport 10*a* will act to pick up the sheet-like elements 10 without the respective rollers being rotated, thereby the sheet-like element 10 is only subjected to an entrainment action as shown diagramatically in FIGS. 5 to 7.

The gripper, 11 or 12, will entrain the sheet-like element which, on leaving the transport 10*a*, will be supported on the web 50 to prevent it from rubbing against previously stacked sheet-like elements.

Toward the end of the entrainment there occurs instantaneously the release of the web 50 which returns to its starting position and subsequent opening of the gripper, thereby the sheet-like element can rest on the stack of sheet-like elements with great accurancy, also in view of the fact that the distance existing in practice between the sheet-like element entrainment area and the stack of the stacked sheet-like elements is greatly reduced.

Where one wishes to effect the tilting over of a sheet-like element, it will be sufficient to raise the bar 80 such that one of the grippers, specifically the gripper 11, has its rollers, subjected to rotation about their axes during the translation thereof, thereby in practice, additionally to entraining the sheet-like element, they will also tilt it over and lay it onto the stack or pile of sheet-like elements starting with the end which is closest to the transport 10*a*.

Also in this case, the web 50 serves the function of preventing the sheet-like element left from the transport 10*a* from rubbing against the other sheet-like elements or against the sheet-like element itself which is being tilted, thus preventing inaccuracies during the positioning phase.

With reference to FIGS. 10 to 13, on the upper portion of the load-bearing frame 1, there is provided an entrainer which comprises an e.g. pneumatic piston 100 supported on the frame 1, the rod 101 whereof is connected opeatively to a carriage 102 that carries a gripping element.

The connection between the rod 101 and carriage 102 is obtained by means of one single cable 103 capable of substantially doubling the translation speed of the carriage 102 relatively to the translation speed of the rod 101.

The single cable 103 has a fixed end 104 at the free end of the piston 100. The cable 103 is trained around a first pulley 105 associated with the free end of the rod 101, and is then connected rigidly, by means of a clamp 106, to the carriage 102 which is slidable in both directions along a guide bar 107 rigid with the frame 101.

From the clamp 106, the cable 103 is trained around a first deflector pulley 109 carried on the frame 1 at the attachmentend of the piston 100, and hence around a second deflector pulley 110 supported on the frame 1, on the opposite side with respect to the end connected to the piston 100.

From the second deflector pulley 110, the cable 103 is trained around a second pulley 111 connected to the free end of the rod 101.

Figure 10:
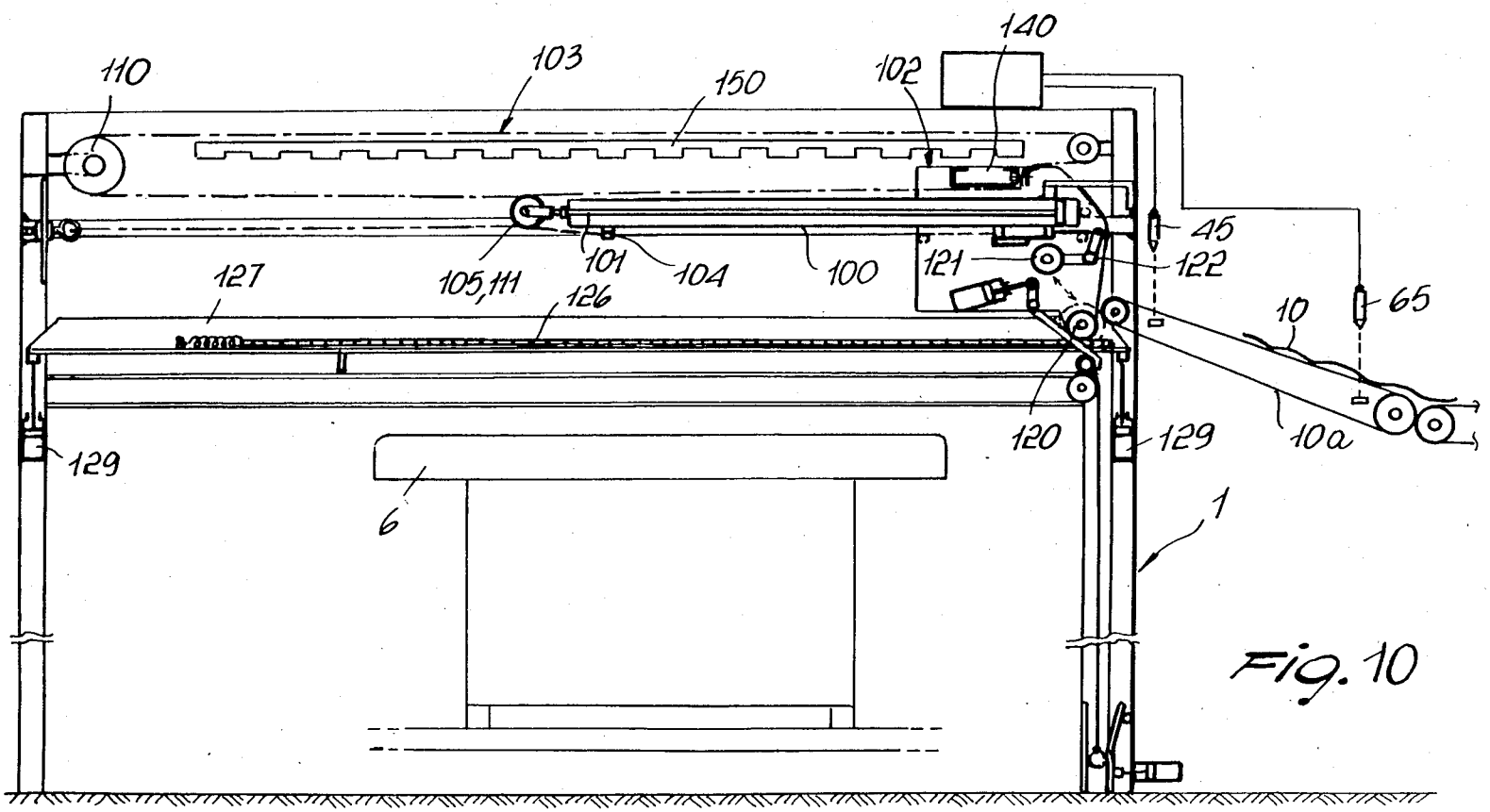
FIG. 10 shows diagrammatically the apparatus according to the invention.
Figure 12:
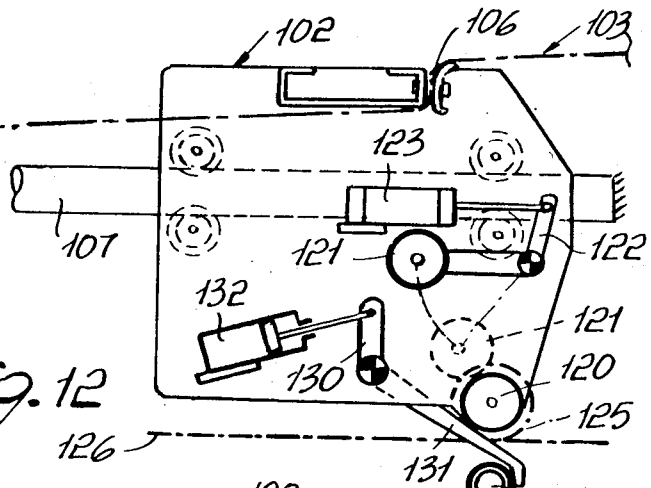
FIG. 12 is a detail view of the movable carriage.
Figure 11:
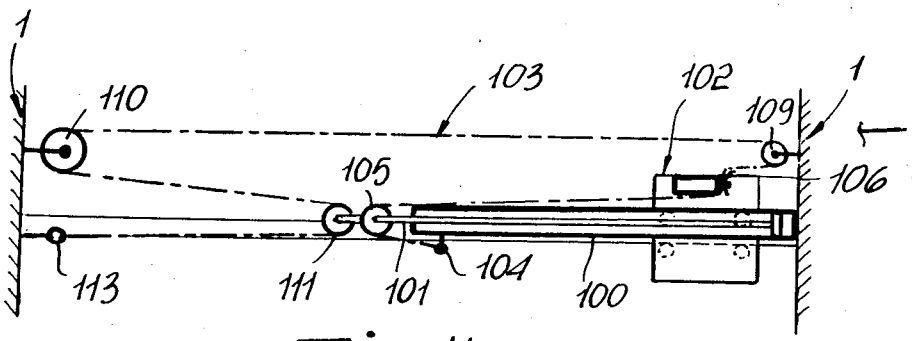
FIG. 11 illustrates the means of connection between a pneumatic piston and movable carriage.
Figure 13:
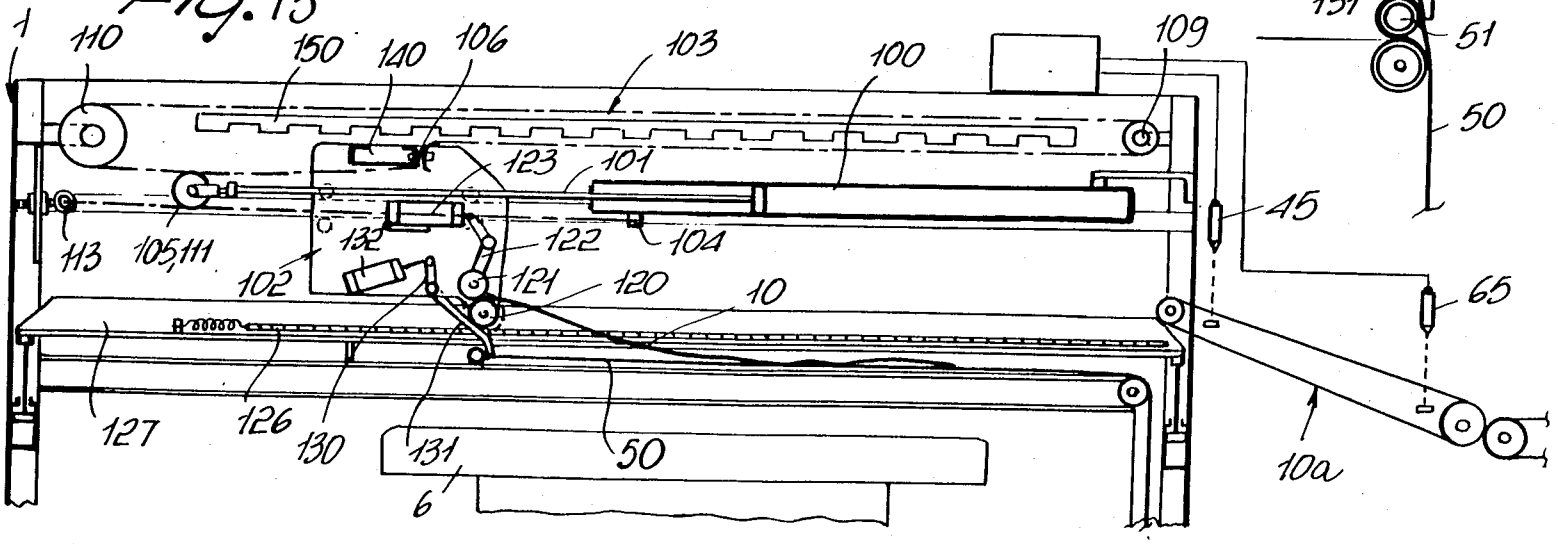
FIG. 13 shows the apparatus with the carriage at a different operative position while a hide or the like is being entrained.

The pulley 111, in FIG. 11, is shown to better illustrate its description offset from the pulley 105, but it is actually more rational construction-wise to have the two pulleys 105 and 111 arranged side-by-side and freely rotatable the one relatively to the other, as shown in FIG. 10.

From the second pulley 111, the cable is connected to a fixed terminal point 113 rigid with the frame 1 on the opposite side with respect to the end connected to the piston 100.

With the single cable arrangement described above, to a reciprocatory movement of the rod 101 there corresponds a reciprocatory movement of double magnitude of the carriage 102 and consequently a doubled reciprocation speed relatively to the reciprocation speed of the rod 101.

The carriage 102 supports a gripping element which comprises a first gripping roller 120, having a fixed axis with respect to the carriage 102, which cooperates with a second gripping roller 121 arranged movable to and from the first gripping roller and being carried rotatably on an angle lever 122 journalled at its middle portion and connected, with the other end, to a first auxiliary piston 123 which effects the oscillation of the angle lever 122 to bring the second roller 121 to contact the roller 120 and effect the picking up of the sheet-like element 10 being fed in on a transport 10*a*.

Coaxially with the first gripping roller 120, there is provided a sprocket pinion 125 which is adapted for mesh engagement with a chain section 126 and is supported on a cross-bar 127, vertically movable by the action of small pistons 129 connected to its ends.

With the arrangement just described, with the cross-bar 127 in the lowered position, no meshing takes place between the sprocket pinion 125 and chain 126, thereby the first gripping roller 120 will not turn as the hide is being entrained.

The roller 120, like the roller 121, is provided with conventional one-way means of rotation which prevent reverse rotation, i.e. rotation in the direction of withdrawal of the sheet-like element toward the transport 10*a*, but allow forward rotation, i.e. rotation in the direction of advancement of the hide through the rollers, as the sprocket pinion 125 meshes with the chain 126 and the sheet-like element is picked up to be tilted over as will be explained hereinafter.

The carriage 102 supports then a lever 130, pivotally associated with the carriage at its middle portion, which has an engagement lug 131 adapted to engage with the upper bar 51 of a web 50, so as to entrain the web during the carriage translation (towards the left as viewed in the drawings), during the picking up of the sheet like element.

The lever 130 is connected, at the remote end from that having the gripping lug 131, to a small release piston 132 which acts on command to release the engagement between the lug 131 and upper bar 51 with consequent re-entering of the web 50, forming the supporting element for the sheet-like element during its entrainment.

The actuation of the piston 100, and the release in succession with disengagement of the supporting element comprised of the web 50 and opening of the rollers 120 and 121 is controlled by the first sensor 45, located on the transport 10*a*, which controls the closing of the rollers 120 and 121 to effect the picking up of the sheet-like element, and by the second sensor 65 which has in practice the function of sensing the length of the sheet-like element to transmit the information to computer means such as a data processor or a reader 140 supported on the carriage which interacts with a measuring bar 150 connected to the frame, which provides in practice the consent to open the pistons 123 and 132 for effecting in succession the release of the web 50 and opening of the gripping element, with consequent falling of the sheet-like element 10 onto the stack being formed.

With the apparatus in operation, where there is no need to tilt over the sheet-like elements alternately, the cross-bar 127 is held in the down position; in this condition, the rollers 120 and 121 are not practically caused to rotate and are closed onto the end of the sheet-like element 10 being fed from the transport 10*a*, thereby they apply an entrainment action to the sheet-like element, by virtue of the rod 101 extending from the piston. As shown, in FIG. 13, the sheet-like element being held back by the rollers 120 and 121 lies down on the web until on reaching the desired length, as computed such that the rear ends of the sheet-like elements placed on the shelf are aligned, the end facing the transport 10*a* being referred to as the rear end, one effects in succession the release of the web 50 and opening of the rollers 120 and 121 with consequent fall of the sheet-like element being entrained onto the stack being formed.

Where the sheet-like element 10 is to be tilted over, the cross-bar 127 is raised to bring the chain 126 into mesh engagement with the sprocket pinion 125, thereby the roller 120 is caused to rotate in a counterclockwise direction as viewed in the drawing, and the roller 121 connected thereto rotates in the opposite direction causing the sheet-like element to be entrained and, as cited above overtakes the supporting web which has the sole function of holding back the rear end of the sheet-like element.

It should be added to the foregoing that once the rollers 120 and 121 have released the hide, the rod 101 is caused to re-enter the piston 100, thus returning the rollers 120 and 121 to their original positions for picking up a successive sheet-like element.

It may be appreciated from the foregoing description that the invention achieves its proposed objects and in particular that an apparatus is provided wherein the sheet-like element is in practice picked up by the transport and entrained with gripper elements which move in very close proximity of the pile or stack of sheet-like elements, guiding it true and releasing it at a much reduced distance from the pile or stack of sheet-like elements, with the advantage that an accurate positioning is always provided.

The invention herein is susceptible to many modifications and variations without departing from the purview of the inventive concept.

Furthermore, all of the details may be replaced with other technically equivalent elements.

In practicing the invention, any materials, dimensions and contingent shapes may be used, according to individual requirements.

I claim:

1. An apparatus for stacking generic sheet-like elements such as sheets hides, boards and the like, comprising at least one stack supporting member; a load-bearing frame overlying said stack supporting member; transport means for conveying sheet-like elements to said load-bearing frame; entrainment means in said load-bearing frame; first and second gripping elements connected to said entrainment means and translating on said load-bearing frame along a translation path for picking up a sheet-like element being fed by said transport means and stacking it on said stack supporting member, each said gripping element comprising a pair of rollers including, respectively, lower and upper rollers and first and second rollers, said rollers of each pair being mutually connected through respective lower and upper arms interlinked around a center pin, and elastic means acting on said arms for elastically closing together said rollers of each pair, tilting over means for alternatively tilting over the sheet-like elements, said tilting over means being carried on said load-bearing frame and including a longitudinal bar vertically reciprocable on said loadbearing frame for engagement with said lower and second rollers of said first and second gripping elements for rotatively driving said lower roller and second roller on said gripping elements translating on said load-bearing frame; a movable element supported on said load-bearing frame for supporting the sheet-like elements as picked up from said transport means, said movable element being actuated by said gripping elements during translation on said load-bearing frame; disengagement means in said load-bearing frame for disengaging said movable element and causing deposition of the picked-up sheet-like element on said stack supporting member, and opening means carried on said load-bearing frame for opening said gripping elements for picking up and releasing the sheet-like elements.

2. An apparatus according to claim 1, wherein said lower roller is rotatively supported on said lower arm, said upper roller is rotatively supported on said upper arm with the interposition of one-way rotation means,- said first roller is rigidly connected to said lower arm and an idler roller engageable with said longitudinal bar, and said second roller is rigidly connected to said upper arm.

3. An apparatus according to claim 1, wherein each of said gripping elements has a guide plate rotatively connected to said entrainment means, said lower roller and said first roller being connected to a fixed point on said plate, said upper roller and said second roller having support axes sliding within a slot defined in said plate to effect opening and/or closing of said gripping elements.

4. An apparatus according to claim 1, wherein said load-bearing frame comprises vertical uprights supporting a crosspiece, said apparatus further comprising a carriage mounted on said crosspiece and carrying said stack supporting member, said crosspiece being vertically reciprocable with respect to said load-bearing frame.

5. An apparatus according to claim 1, wherein said entrainment means comprises a chain and first and second sprockets rotatively supported on said load-bearing frame for endlessly training said chain.

6. An apparatus according to claim 1, wherein said opening means includes a cam element supported on said load-bearing frame at said translation path for engaging said center pin of said gripping elements during entrainment of said gripping elements thereby said upper roller and second roller of said first and second gripping means are pushed away from said lower and first rollers, respectively, said apparatus further comprising a sheet-like element feed-in sensor at said transport means for detecting the length of the sheet-like elements.

7. An apparatus according to claim 1, wherein each of said gripping elements has a guide plate including a lug, said movable element comprises a web having, in a rest position thereof, upper and lower ends, said upper end of said web, in said rest position, protruding in said translation path of said gripping elements and thereby defining an engagement position, and said lower end of said web having a counterweight, and said disengagement means comprises a disengagement cam arranged at said translation path downstream of said engagement position with respect to the translation of said gripping elements, thereby during entrainment of said gripping elements in said load-bearing frame said lug interacts with said upper end of said web causing entrainment of said web and, on interaction of said disengagement cam with said lug, said lug is moved away from said upper end of said web and said counterweight returning said web to said rest position.

8. An apparatus for stacking generic sheet-like elements such as sheets, hides, boards and the like, comprising a stack supporting member; a load-bearing frame overlying said stack supporting member; transport means for conveying sheet-like elements to said load-bearing frame; a movable carriage translatable on said load-bearing frame along a reciprocation path; an entrainer supported on said load-bearing frame and including a piston supported on said load-bearing frame and having a rod operatively connected to said movable carriage; a gripping element supported on said moveable carriage and including a first gripping roller having a rotation axis rigid with said movable carriage and a second gripping roller having a rotation axis connected to a lever element journalled to said movable carriage; a small auxiliary piston supported on said movable carriage and connected to said lever element for oscillating said lever element and bringing said second gripping roller against and away from said first gripping roller for picking up a sheet-like element being fed by said transport means and stacking it on said stack supporting member; a supporting element for the sheet-like elements, carried on said load-bearing frame and movable therealong; actuating means carried on said movable carriage and including a lever journalled to said movable carriage, said lever being connected at one end thereof to a small release piston and defining a gripping lug, said small release piston causing the oscillation of said lever for selectively bringing said gripping lug in engagement with and disengaging said gripping lug from said supporting element; first and second sensors at said transport means for sensing the introduction of a sheet-like element into said apparatus and sensing the length of the introduced sheet-like element, said sensors controlling the actuation of said piston, of said small auxiliary piston and said small release piston.

9. An apparatus according to claim 8, wherein said piston is connected to said movable carriage through a cable doubling the reciprocation speed of said movable carriage relatively to the reciprocation speed to said rod.

10. An apparatus according to claim 8, comprising a first pulley rotatably supported on a free end of said rod, a deflector pulley supported on said load-bearing frame at a position near to a first end of said reciprocation path of said movable carriage; a second deflector pulley connected to said load-bearing frame on a remote side relatively to said first end of said reciprocation path, said piston being connected to said movable carriage through a cable having first and second ends, said cable having said first end fixed to said free end of said rod, being trained around said first pulley, having a middle point rigidly connected to said carriage, being trained around said first deflector pulley, and around said second deflector pulley, running over said second deflector pulley and being connected at said second end thereof with said load-bearing frame at said remote side.

11. An apparatus according to claim 8, further comprising tilting over means for tilting over a sheet-like element being entrained by said gripping element, comprising at least one sprocket pinion coaxial with said first gripping roller and removably engageable with a chain supported on a cross-bar movable with respect to said load-bearing frame in a vertical direction, said first and second gripping rollers having one-way rotation means for preventing rotation in the direction of withdrawal of the sheet-like element on the side of said transport means for feeding the sheet-like elements.

12. An apparatus for stacking generic sheet-like elements such as sheets, hides, boards and the like, comprising a stand; a load-bearing frame overlying said stand; transport means for conveying sheet-like elements to said load-bearing frame; a movable carriage translatable on said load-bearing frame; an entrainer supported on said load-bearing frame and including a piston supported on said load-bearing frame and having a rod operatively connected to said movable carriage; a gripping element supported on said movable carriage and including a first gripping roller having a rotation axis rigid with said movable carriage and a second gripping roller movable to and from said first gripping roller; and tilting over means for tilting over a sheet-like element being entrained by said gripping element, comprising at least one sprocket pinion coaxial with said first gripping roller and removably engageable with a chain supported on a cross-bar movable with respect to said load-bearing frame in a vertical direction, said first and second gripping rollers having one-way rotation means for preventing rotation in the direction of withdrawal of the sheet-like element on the side of said transport means for feeding the sheet-like elements.

* * * * *